US011685021B2

(12) United States Patent
Herrod

(10) Patent No.: US 11,685,021 B2
(45) Date of Patent: Jun. 27, 2023

(54) TRAPDOOR CLAMP

(71) Applicant: Don Herrod, Sahuarita, AZ (US)

(72) Inventor: Don Herrod, Sahuarita, AZ (US)

( * ) Notice: Subject to any disclaimer, the term of this patent is extended or adjusted under 35 U.S.C. 154(b) by 41 days.

(21) Appl. No.: 17/219,476

(22) Filed: Mar. 31, 2021

(65) Prior Publication Data

US 2022/0314401 A1 Oct. 6, 2022

(51) Int. Cl.

| | |
|---|---|
| ***B25B 5/10*** | (2006.01) |
| ***B25B 5/16*** | (2006.01) |
| ***B25B 5/14*** | (2006.01) |
| ***B25B 5/04*** | (2006.01) |

(52) U.S. Cl.

CPC ..... *B25B 5/103* (2013.01); *B25B 5/04* (2013.01); *B25B 5/147* (2013.01); *B25B 5/163* (2013.01)

(58) Field of Classification Search

CPC ..... B25B 5/103; B25B 5/04; B25B 5/147; B25B 5/163

See application file for complete search history.

(56) References Cited

U.S. PATENT DOCUMENTS 2,893,458 A * 7/1959 Flora ..... E05B 1/0015 411/970
3,913,187 A * 10/1975 Okuda ..... F16L 3/1075 24/484
5,305,978 A * 4/1994 Current ..... F16L 3/1075 248/230.4
5,665,936 A * 9/1997 Sawamura ..... H02G 7/12 174/32
6,257,537 B1 * 7/2001 Williams ..... A01M 29/32 248/213.1
8,056,868 B2 * 11/2011 Vander Griend ..... F16L 3/1075 248/68.1
8,881,469 B1 * 11/2014 Meyer ..... E04D 13/1606 52/444
8,979,039 B2 * 3/2015 Shiga ..... F16L 55/035 174/40 CC
9,482,368 B1 * 11/2016 Hung ..... F16B 2/10
9,638,402 B2 * 5/2017 Paradiso ..... F16B 35/005
2012/0091290 A1 * 4/2012 Shitamichi ..... H02G 3/0487 248/65
2012/0312552 A1 * 12/2012 Rayssiguier ..... E21B 17/023 166/380

* cited by examiner

*Primary Examiner* — Anita M King
(74) *Attorney, Agent, or Firm* — Lyman Moulton, Esq.; Moulton Patents, PLLC

(57) ABSTRACT

The Trapdoor Clamp is the only product of its kind that allows individuals to safely place tools onto a highly adjustable platform to improve functionality of modern aerial lifts. The Trapdoor Clamp is uniquely designed with durable materials like rubber and metal to withstand force and ensure sustainability during operation. The clamp includes a channel having three sides defining open ends thereto, a trapdoor configured to create an open ended box with the three sided channel, a hinge configured to lengthwise join the trapdoor with the three sided channel, a trapdoor extension from the trapdoor, a stationary extension from the three sided channel configured to be in an opposing relation with the stationary extension and a fastener configured to put the trapdoor extension and the stationary extension in a compression.

19 Claims, 4 Drawing Sheets

TRAPDOOR CLAMP

BACKGROUND

Boom, scissor, and articulating lifts are all regularly used in common construction and maintenance projects. Such equipment efficiency, however, is countered due to the lack of space to carry or hold other tools and materials that are needed to complete an operation. This in return creates an incredibly time consuming and frustrating situation for an individual and decreases productivity. There have been no products available as original equipment or as an aftermarket to address this problem.

An apparatus to simplify and enhance functionality and efficiency in construction and maintenance projects. There have been no products available as original equipment or as an aftermarket to address this problem either.

There exists a need for a device and a system such as the Trap Door Clamp Bracket, that is not being met by any known or disclosed device or system of present.

SUMMARY OF THE INVENTION

The disclosed Trapdoor Clamp enhances the functionality of a conventional clamp. The Trapdoor Clamp ensures clamping at all times and precludes the hassle of operation of other clamps or objects.

The clamp includes a channel having three sides defining open ends thereto, a trapdoor configured to create an open ended box with the three sided channel, a hinge configured to lengthwise join the trapdoor with the three sided channel, a trapdoor extension from the trapdoor, a stationary extension from the three sided channel configured to be in an opposing relation with the stationary extension and a fastener configured to put the trapdoor extension and the stationary extension in a compression.

Embodiments include a crenelated bracket attached to an inside wall of the trapdoor and an opposing crenelated bracket attached to an inside wall of the channel. A piping within the clamp provides a stop to an inward swing of the trapdoor. An increase and a decrease in the compression is based on a respective decrease and increase in a length between the trapdoor extension and the stationary extension parallel to the fastener in operation therewith.

Figure 1:
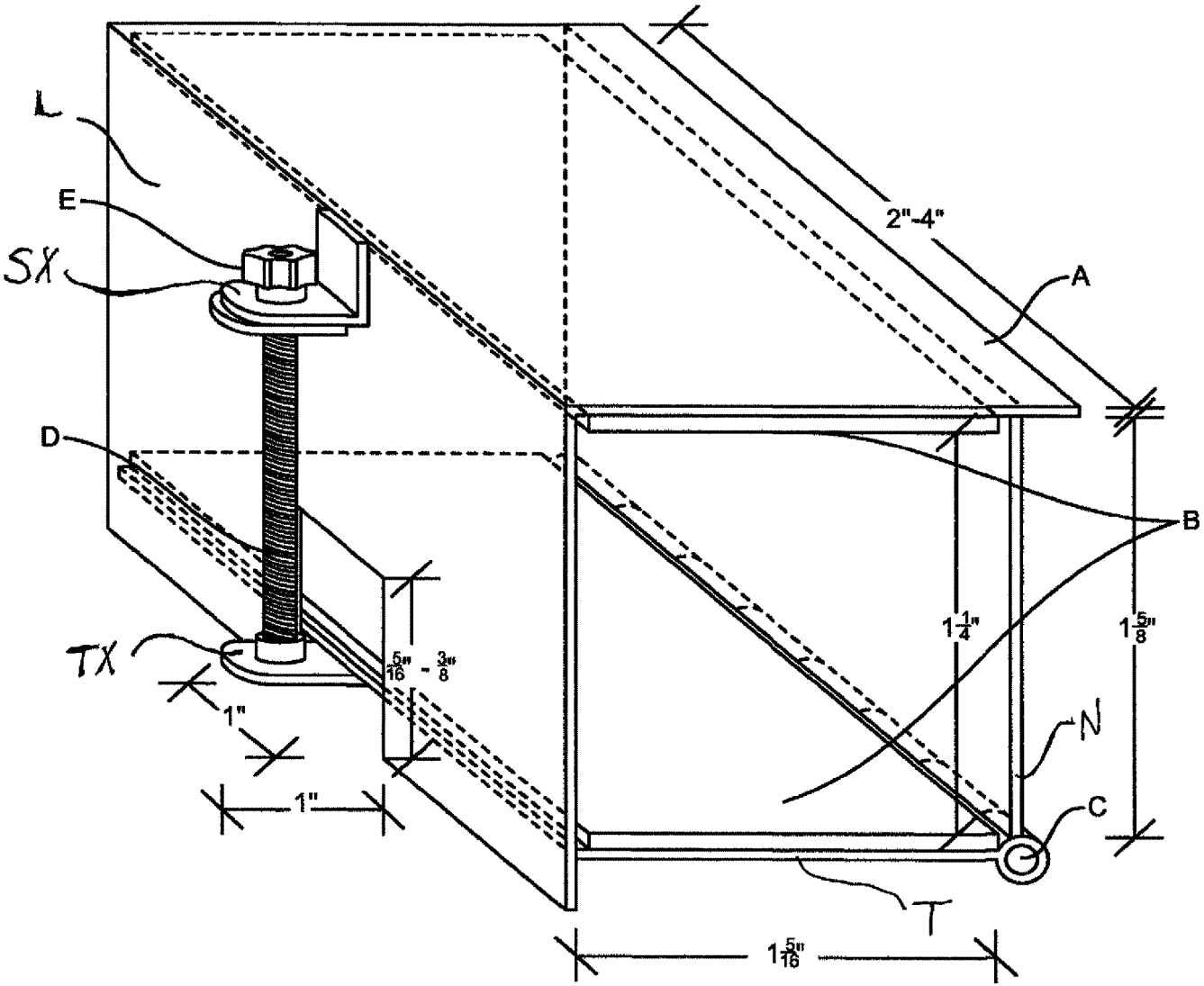
FIG. 1 This is a side perspective view of the Trapdoor Clamp apparatus in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The term 'annularly' used herein is taken from the common definition for annular meaning ring or circumscribing. The term 'trapdoor,' used throughout the disclosure defines a hinged or removable panel or part in a floor, ceiling or roof but more generally defines an access to some structure which in this case is an open ended box clamp.

FIG. 1. This is a side perspective view of the Trapdoor Clamp apparatus showing: A. third side metal plate, B. ⅛" Rubber blocks with 1/16" tape, C. Hinge, D. 5/16"-⅜" Threaded knob, E. fastener, and L. Fourth side metal plate also known as a Hinged box shackle in accordance with an embodiment of the present disclosure. The view also includes the trapdoor side T, the second side N, the stationary extension SX and the trapdoor extension TX.

Figure 2:
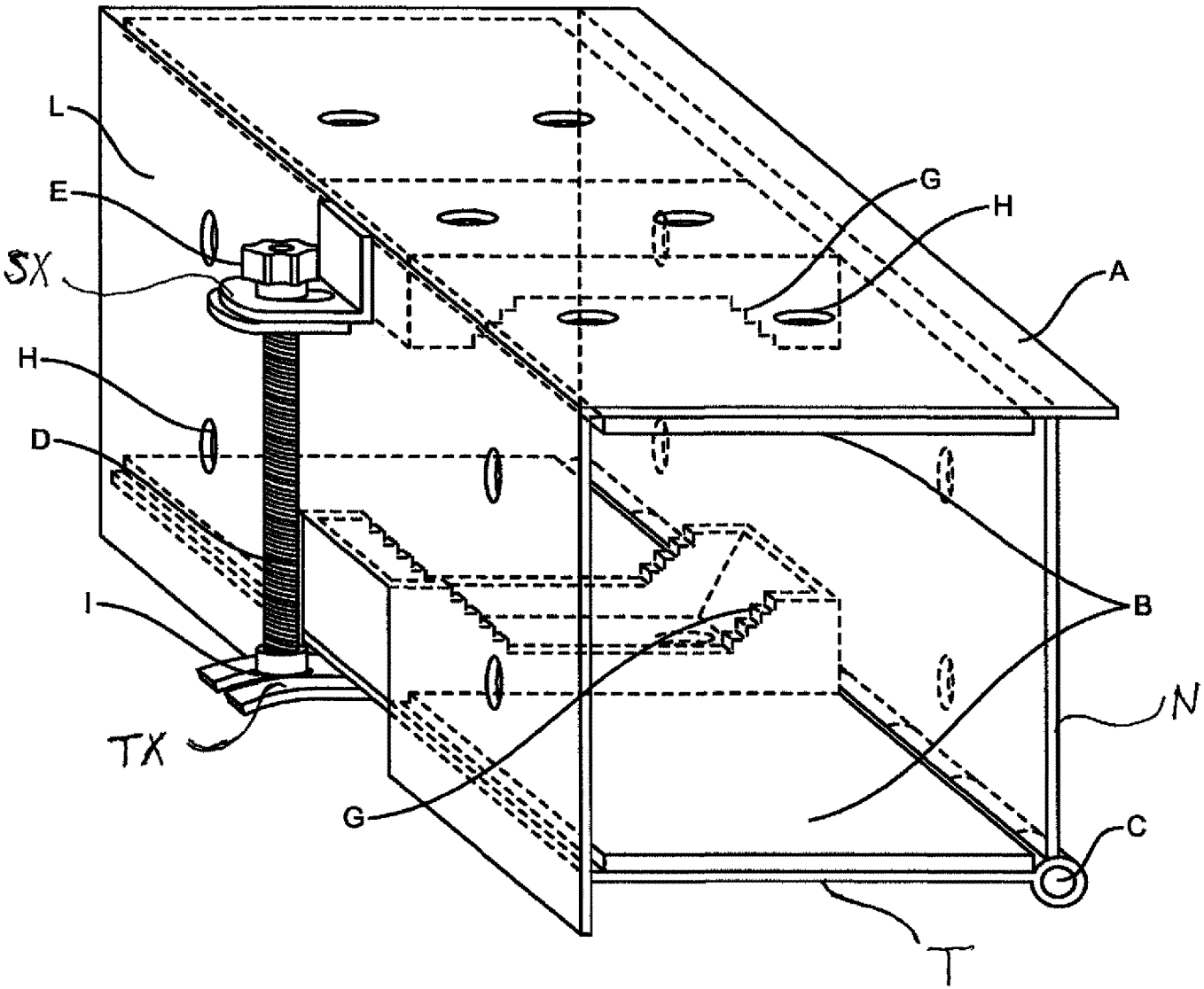
FIG. 2. This is a side perspective view of the Trapdoor Clamp apparatus with pipe accommodations in accordance with an embodiment of the present disclosure.

FIG. 2. This is a side perspective view of the Trapdoor Clamp apparatus with pipe accommodations showing: A. Metal plate also known as the third side, B. ⅛" Rubber blocks with 1/16" tape, C. Hinge, D. 5/16"-⅜" Threaded knob, E. fastener, G. Insert for round steel tube, H. Holes for screws or nuts, I. Recessed hex or square to lock in place and L. fourth side metal plate in accordance with an embodiment of the present disclosure. The view also includes the trapdoor side T, the second side N, the stationary extension SX and the trapdoor extension TX.

Figure 3:
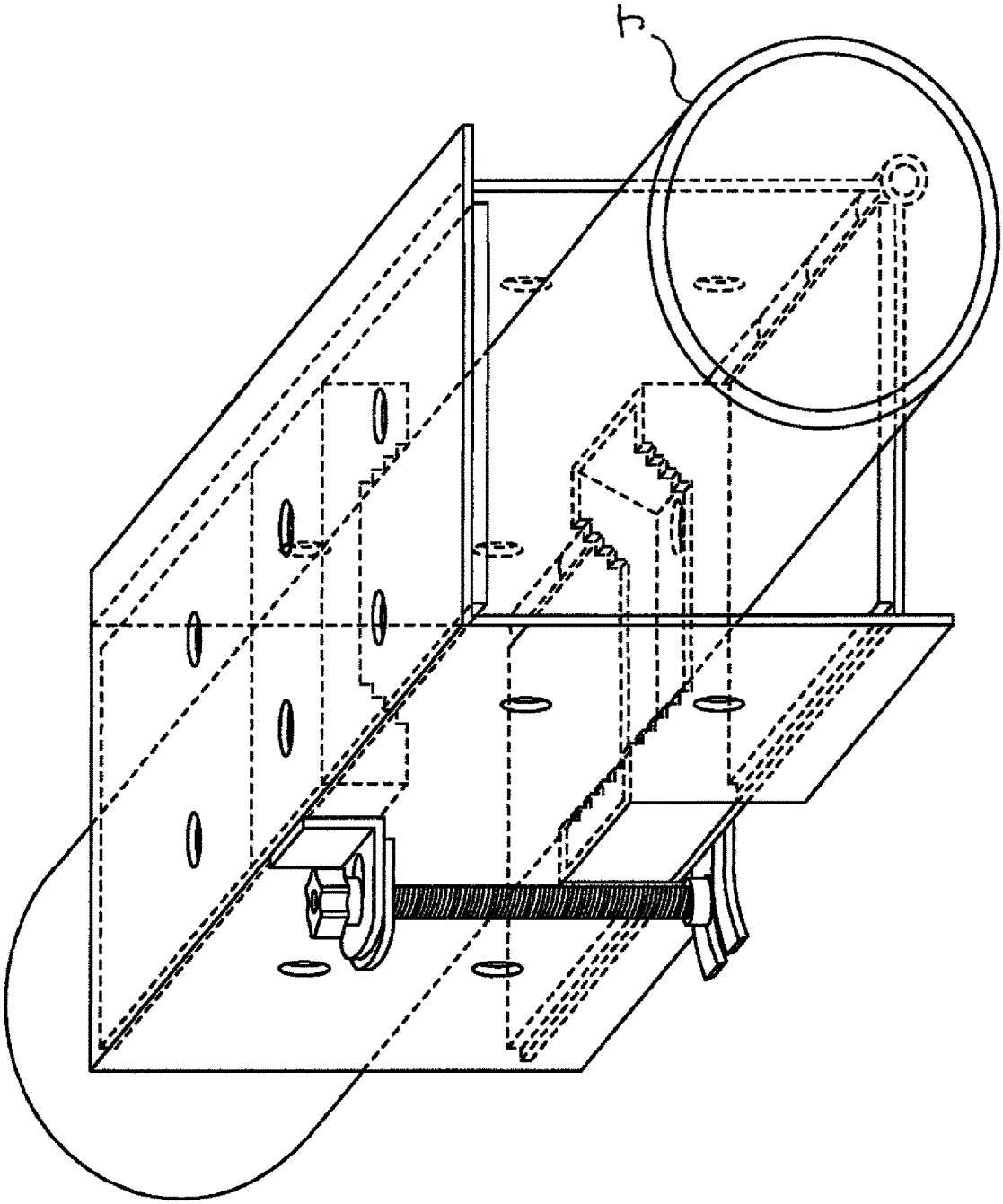
FIG. 3. This is a side perspective view of the Trapdoor Clamp apparatus with a pipe in accordance with an embodiment of the present disclosure.

FIG. 3. This is a side perspective view of the Trapdoor Clamp apparatus accommodating a pipe J. The disclosure attaches to square or round tubes, horizontally and vertically in accordance with an embodiment of the present disclosure.

Figure 4:
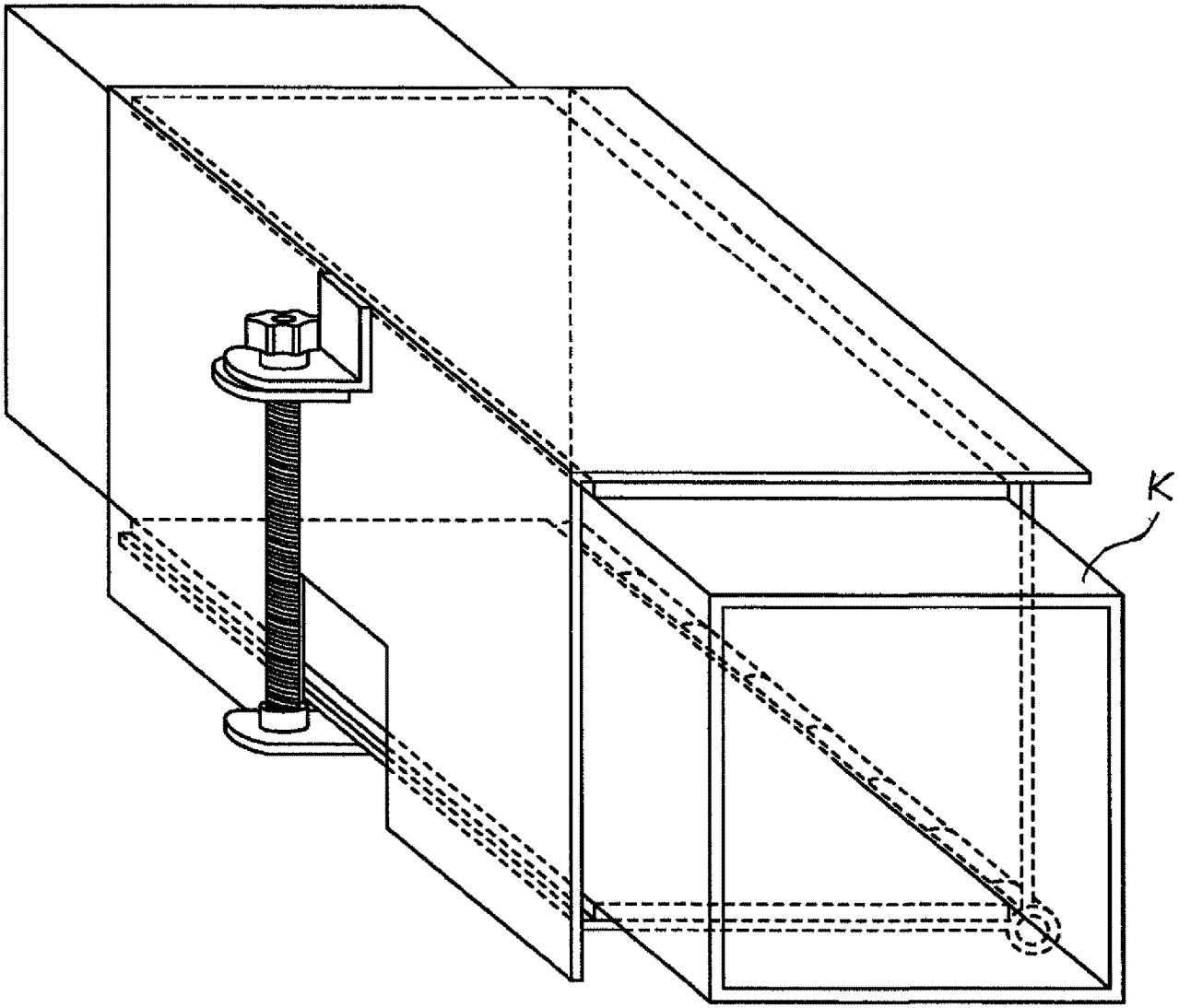
FIG. 4. This is a side perspective view of the Trapdoor Clamp apparatus accommodating a tube in accordance with an embodiment of the present disclosure.

FIG. 4. This is a side perspective view of the Trapdoor Clamp apparatus accommodating a tube K. The disclosure attaches to square or round tubes, horizontally and vertically in accordance with an embodiment of the present disclosure.

Expanding on the conventional clamp design, this innovative product introduces a novel mounting clamp that attaches securely to pipe and tubes and could be used with a variety of interchangeable attachments. The metal plate is located on the front surface of a hinged box shackle and is connected to a threaded knob, fastener, and recessed hex to lock in place and guarantee a stable environment. Possessing strategically placed holes and compartments, the disclosure was curated to carry heavy round steel tubes, as needed.

Various brackets are attached to the clamp for shackling to other components not limited to seat belts, ski lifts, recreational vehicles, grocery cart retainers, animal care, sports and safety mechanisms and devices.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A clamp comprising:

a hinge configured to join a trapdoor side and a second side;

a third side joined to the second side and a fourth side joined to the third side, wherein one of the third side and the fourth side comprises a stationary extension, wherein the trapdoor side is configured to move on the hinge three hundred and sixty degrees;

a trapdoor extension from the trapdoor side configured to be in a compression relation with the stationary extension; and a fastener configured to put the trapdoor side in compression with an open ended box created by the trapdoor, the second, third and fourth sides via the trapdoor extension and the stationary extension.

2. The clamp of claim 1, wherein the trapdoor extension comprises a slot to receive the fastener.

3. The clamp of claim 1, wherein the trapdoor extension defines an opening configured to annularly receive the fastener.

4. The clamp of claim 1, wherein the fastener is a threaded bolt.

5. The clamp of claim 1, wherein the trapdoor side, the second, third and fourth sides define openings configured to receive screws, bolts and fasteners there through.

6. The clamp of claim 1, further comprising a crenelated bracket attached to an inside wall of the trapdoor side and an opposing crenelated bracket attached to an inside wall of the third side.

7. The clamp of claim 1, wherein the trapdoor extension comprises a lip form drooping away from the compression with the stationary extension.

8. The clamp of claim 1, further comprising a threaded knob on the fastener configured to fix a length between the trapdoor extension and the stationary extension.

9. The clamp of claim 1, further comprising a recess on the trapdoor extension configured to receive a bolt on the fastener in a fixed relation to the trapdoor extension.

10. The clamp of claim 1, further comprising a rubber material on an inside surface of the clamp configured to inhibit an item in the clamp from moving therein.

11. The clamp of claim 1, wherein the stationary extension defines a slot defined therein to receive the fastener.

12. The clamp of claim 1, wherein the stationary extension defines an opening defined to annularly receive the fastener.

13. The clamp of claim 1, further comprising a retaining nut on the fastener configured to keep a distance between the trapdoor extension and the stationary extension constant.

14. The clamp of claim 1, further comprising a circular pipe in compression within the clamp to provide a stop to an inward swinging motion of the trapdoor side.

15. The clamp of claim 1, further comprising a square pipe in compression within the clamp to provide a stop to an inward swinging motion of the trapdoor side.

16. A clamp comprising:

a channel having three sides defining open ends thereto;

a trapdoor configured to create an open ended box with the three sided channel;

a hinge configured to lengthwise join the trapdoor with the three sided channel, wherein the trapdoor is configured to move on the hinge three hundred and sixty degrees;

a trapdoor extension from the trapdoor;

a stationary extension from the three sided channel configured to be in an opposing relation with the stationary extension; and a fastener configured to put the trapdoor extension and the stationary extension in a compression.

17. The clamp of claim 16, further comprising a crenelated bracket attached to an inside wall of the trapdoor and an opposing crenelated bracket attached to an inside wall of the channel.

18. The clamp of claim 16, further comprising a piping within the clamp to provide a stop to an inward swing of the trapdoor.

19. The clamp of claim 16, further comprising an increase and a decrease in the compression based on a respective decrease and increase in a length between the trapdoor extension and the stationary extension parallel to the fastener in operation therewith.

* * * * *